US007470383B2

(12) United States Patent
Haney et al.

(10) Patent No.: US 7,470,383 B2
(45) Date of Patent: Dec. 30, 2008

(54) SUBMERSIBLE PUMP DROP PIPE AND CASING ASSEMBLY CONNECTION AND METHOD OF MANUFACTURE

(75) Inventors: Morris G. Haney, Beeville, TX (US); Roy L. Thein, Okla City, OK (US)

(73) Assignee: Johnson Screens, Inc., Houston, TX (US)

( * ) Notice: Subject to any disclaimer, the term of this patent is extended or adjusted under 35 U.S.C. 154(b) by 0 days.

(21) Appl. No.: 10/744,518

(22) Filed: Dec. 23, 2003

(65) Prior Publication Data

US 2004/0135372 A1 Jul. 15, 2004

Related U.S. Application Data

(63) Continuation of application No. 09/989,512, filed on Nov. 20, 2001, now Pat. No. 6,666,480.

(51) Int. Cl.
*B29C 47/00* (2006.01)
*F16L 15/00* (2006.01)

(52) U.S. Cl. ..... 264/150; 264/40.5; 264/148; 264/152; 264/159; 264/209.1; 264/209.3; 264/209.4; 264/296; 264/322; 285/390; 285/333; 285/334; 285/115; 285/423

(58) Field of Classification Search ..... None
See application file for complete search history.

(56) References Cited

U.S. PATENT DOCUMENTS 2,107,716 A 2/1938 Singleton
2,258,066 A 10/1941 Oyen
2,289,271 A 7/1942 Kane et al.
2,366,067 A * 12/1944 Smith ..... 285/107
2,574,081 A 11/1951 Abegg
3,336,054 A 8/1967 Blount et al.
3,495,301 A * 2/1970 Larsen et al. ..... 425/392
3,508,771 A * 4/1970 Duret ..... 285/334
3,802,908 A * 4/1974 Emmons ..... 427/398.3
3,856,906 A * 12/1974 Edgar ..... 264/138
3,910,744 A * 10/1975 Ronden et al. ..... 425/384
3,923,433 A * 12/1975 Hermes et al. ..... 418/83
4,059,379 A * 11/1977 Korff et al. ..... 425/393
4,134,949 A * 1/1979 McGregor ..... 264/519
4,154,466 A 5/1979 Simmons
4,266,813 A 5/1981 Oliver
4,373,754 A 2/1983 Bollfrass et al.
4,426,105 A 1/1984 Plaquin et al.
4,501,443 A 2/1985 Haring (Continued)

OTHER PUBLICATIONS

Mid-Continent PVC Water Well Casings and Screens, Apr. 1975.

(Continued)

*Primary Examiner*—Monica A Huson
*Assistant Examiner*—Jeff Wollschlager
(74) *Attorney, Agent, or Firm*—Gunn, Lee & Cave, PC

(57) ABSTRACT

A submersible pump drop pipe and casing assembly and method of manufacture is disclosed. The drop pipe/casing has a seated connector and base. The seated connector has a first and second cylinder section, the first cylinder section being used to align and direct the base into the seated connector and to provide lateral strength to the pipe.

10 Claims, 7 Drawing Sheets

U.S. PATENT DOCUMENTS

| | | | | | |
|---|---|---|---|---|---|
| 4,570,982 | A | | 2/1986 | Blose et al. | |
| 4,591,195 | A | | 5/1986 | Chelette et al. | |
| 4,796,928 | A | | 1/1989 | Carlin et al. | |
| 4,893,658 | A | | 1/1990 | Kimura et al. | |
| 5,015,014 | A | | 5/1991 | Sweeney | |
| 5,018,555 | A | | 5/1991 | Hawerkamp | |
| 5,078,430 | A | * | 1/1992 | St. Onge | 285/15 |
| 5,106,130 | A | | 4/1992 | Ellsworth et al. | |
| 5,251,942 | A | * | 10/1993 | Whaley | 285/355 |
| 5,360,240 | A | | 11/1994 | Mott | |
| 5,398,975 | A | | 3/1995 | Simmons | |
| 5,622,670 | A | * | 4/1997 | Rowley | 264/494 |
| 5,738,388 | A | | 4/1998 | Sundelin | |
| 5,826,921 | A | | 10/1998 | Woolley | |
| 5,827,467 | A | * | 10/1998 | Ruppert et al. | 264/322 |
| 6,209,926 | B1 | | 4/2001 | Mastro | |
| 6,660,199 | B2 | * | 12/2003 | Siferd et al. | 264/150 |
| 6,666,480 | B2 | * | 12/2003 | Haney et al. | 285/390 |

OTHER PUBLICATIONS

VMT Fiberglass Industries GLASSPOL Fiberglass Reinforced Plastic Pipe and Screens, Jan. 1998.

* cited by examiner

SUBMERSIBLE PUMP DROP PIPE AND CASING ASSEMBLY CONNECTION AND METHOD OF MANUFACTURE

This is a continuation application claiming priority to U.S. patent application Ser. No. 09/989,512 filed Nov. 20, 2001 now U.S. Pat. No. 6,666,480.

BACKGROUND OF THE INVENTION

1. Field of the Invention

Applicant's invention relates to a submersible pump drop pipe and casing assembly connection and method of manufacture for use in water well and related systems.

2. Background Information

In water well systems, a casing is inserted into the well to maintain the structure of the well. Within the well is placed a submersible pump to which is attached a drop pipe which carries the water from within the well to the surface. It is important in this system that the drop pipe not leak. Therefore, in modern practice pipes are joined together with couplings and sealed with large amounts of either cement or "pipe dope" to prevent leaking. The positioning of the couplings can take a great deal of effort to do properly. In addition, pipe "dope" and cement have long curing times which makes what should be a relatively short job incredibly time consuming. Unfortunately, with current practices and materials, well drillers do not have the ability to run the pipes into the well by simply and rapidly screwing one pipe into another.

Surprisingly, the present invention allows the driller to run one pipe into the well, align and screw in the next pipe, and continue until complete. No couplings are necessary. The pipes of the present invention do not require the use of large amounts of cements or pipe "dope" to obtain the water tight seal, only small amounts of threading compound need be used to ensure there is no accidental disconnection of the pipes in the future and to allow for the pipes to be easily disconnected in the future should the occasion arise. In addition, the driller does not spend time cleaning the pipe and threads of excess compound if maintenance must be made of the well pipes.

Of interest is that maintenance of well pipes can often create more problems than may have existed simply due to the design of current pipes. Existing pipe designs lack a significant degree of lateral strength such that if a section of pipe must be unscrewed and removed, the force needed to overcome the strength of the bonding agent can sheer the pipe and strip the threads. It is noteworthy; however, that the invention of the present application has a high degree of lateral strength. It was found that it takes 5,000 pounds of pull on a 2 inch pipe to break the pipe. In addition, it was found that laterally pushing on the pipe, a force of 1,000 pounds has to be exerted before the pipe will start leaking.

More specifically, the present invention utilizes two pipes for either the drop pipe or casing. When the two pipes are connected together a specially configured first cylinder section on the first pipe is used to align and direct the male threaded end of the second pipe into the first pipe to the second cylinder section which is also threaded. The two pipes are then screwed together. The water tight seal is formed by screwing the two ends of pipe together. In addition, because the first cylinder section extends out for approximately one inch, any lateral forces on the connection are exerted against the first cylinder section instead of on the second cylinder section, which is threaded. This gives lateral strength to the pipe.

SUMMARY OF THE INVENTION

It is an object of the present invention to provide a novel submersible pump drop pipe assembly connection.

It is another object of the present invention to provide a novel water well casing assembly connection.

It is another object of the present invention to provide a novel method of manufacture for a submersible pump drop pipe and casing assembly connection.

Still another object of the present invention is to provide a novel submersible pump drop pipe/casing assembly connection that has a seated connector and base.

Another object of the present invention is to provide a novel submersible pump drop pipe/casing assembly connection that has a seated connector with a first and second cylinder section.

It is another object of the present invention to provide a novel submersible pump drop pipe/casing assembly connection with a seated connector that has a first cylinder section to align and direct the base into it.

Yet another object of the present invention is to provide a novel submersible pump drop pipe assembly connection that forms a water tight seal when the seated connector and base are connected.

Still another object of the present invention is to provide a novel submersible pump drop pipe/casing assembly connection that reduces the time spent cleaning the pipe and threads of excess compound.

Another object of the present invention is to provide a novel submersible pump drop pipe/casing assembly connection that does not require couplings.

In satisfaction of these and related objectives, Applicant's present invention provides a submersible pump drop pipe and casing assembly connection and method of manufacture. The drop pipe/casing has a seated connector and base. The seated connector has a first and second cylinder section, the first cylinder section being used to align and direct the base into the seated connector and to provide lateral strength to the pipe.

DETAILED DESCRIPTION OF THE PREFERRED EMBODIMENT

Figure 1:
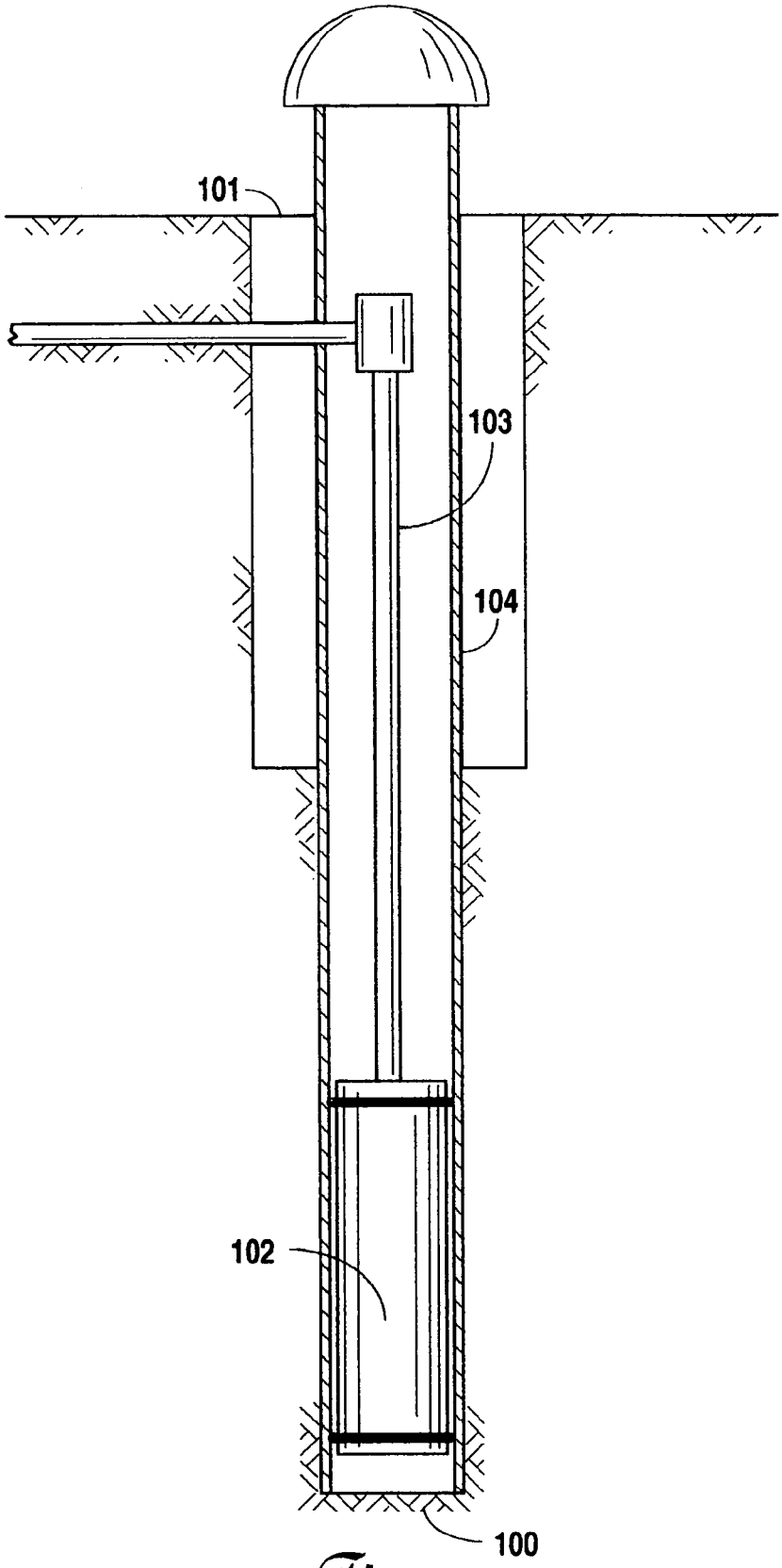
FIG. 1 is a cut away view of a typical water well.

Referring to FIG. 1, a schematic of a typical water well where the present submersible pump drop pipe and casing could be used is illustrated. While the present invention can be useful in other obvious applications, the preferred use of the present invention is in water wells 101. The water well 101 may be drilled into an aquifer 100. The aquifer 100 is simply a water-bearing layer of sediment or rock with interconnected pore spaces or fractures that accumulate water. Upon drilling into the aquifer 100 the water well 101 is formed. Several components are inserted within the water well 101 which are necessary for its function. However, for purposes of the present invention, only certain key components will be addressed.

Within the water well 101 is placed casing 104 to keep the water well 101 open. Within the casing 104 and at the base of the water well 101 is inserted a submersible pump 102. Pump 102 is simply a motor or pump assembly that is designed to be placed entirely below the water surface and can be constructed of any standard specifications. A drop pipe 103 is placed within the casing 104 and connects at one end to the submersible pump 102. The drop pipe 103 is the pipe that carries water from the pump 102 in the water well 101 up to the surface.

Figure 2A:
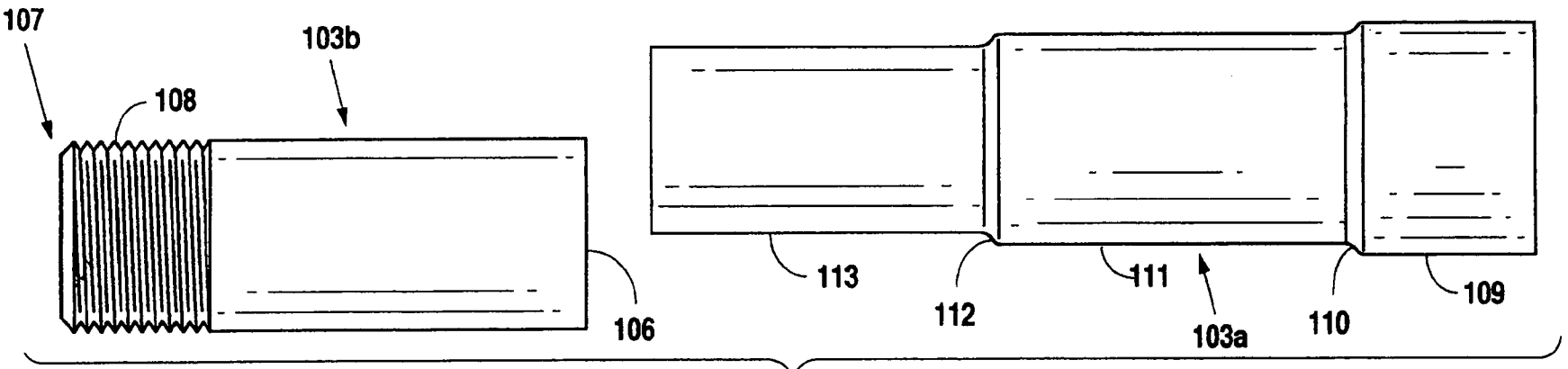
FIG. 2*a* is a perspective view of the drop pipe of the present invention.
Figure 2B:
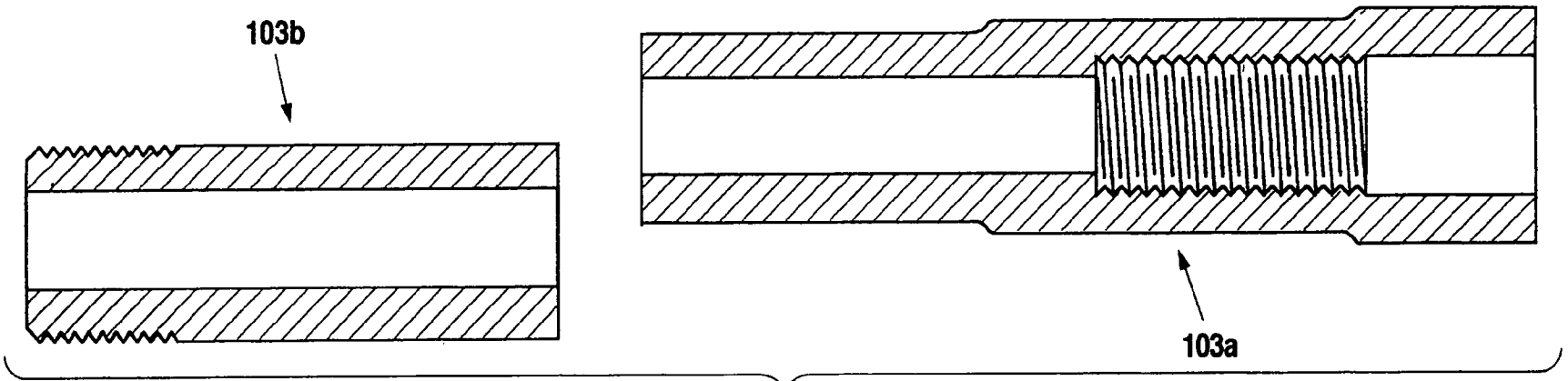
FIG. 2*b* is a perspective view illustrating the inside design of the drop pipe of the present invention

The drop pipe 103 of the present invention is illustrated in more detail in FIGS. 2*a* and 2*b*. Drop pipe 103 consists of two parts, a seated connector 103*a* and a base 103*b*. Base 103*b* is constructed of one piece of PVC pipe. The base 103*b* connects at first end 106 with the submersible pump 102 and at its second end 107 with seated connector 103*a*. Second end 107 is flat and beveled at the end and has triangular male threads 108 along a portion of its length, preferably approximately 1 inch. When connecting with seated connector 103*a*, which is also constructed of one piece of PVC pipe, second end 107 passes through first cylinder section 109 and first lipped portion 110 which contain no internal threads. First cylinder section 109 is wider in diameter than second end 107 by preferably approximately ½ inch to allow the ease of insertion of second end 107 into first cylinder section 109.

Next second end 107 enters into second cylinder section 111 which contains triangular female threads 114. The beveled portion of second end 107 tends to direct the pipe into the threaded portion along with a beveled portion on the inside of the first cylinder section 109. The first lipped portion 110 also aids in this transition. Second cylinder section 111 is not wide enough to allow for ease of insertion of the second end 107 and is manufactured to allow for a water tight connection. Threads 108 of second end 107 are intended for threading onto threads 114 to provide this water tight connection. Threads 114 are placed within second cylinder section 111 for a length sufficient enough to provide for this connection, such length being preferably approximately ⅔ inch. The second cylinder section 111 connects with a second lipped portion 112. Second lipped portion 112 terminates into the terminal section 113. Terminal section 113 extends to the surface of the water well 101.

Essentially, when the seated connector 103*a* and base 103*b* are brought together the specially configured first cylinder section 109 on the seated connector 103*a* is used to direct the male threaded end of the base 103*b* into the seated connector 103*a* to the second cylinder section 111 which is also threaded. The seated connector 103*a* and base 103*b* are then screwed together. Because the first cylinder section 109 extends out for approximately one inch, any lateral forces on the connection are exerted against the first cylinder section instead of on the second cylinder section 111, which is threaded. This gives lateral strength to the drop pipe 103. Tests were performed on pipe 103 to test the degree of lateral strength. It was found that it took 5,000 pounds of pull on a 2 inch pipe to break the pipe 103. It was also found that laterally pushing on the pipe 103 a force of approximately 1,000 pounds has to be exerted before the pipe 103 will start leaking.

Figure 3A:
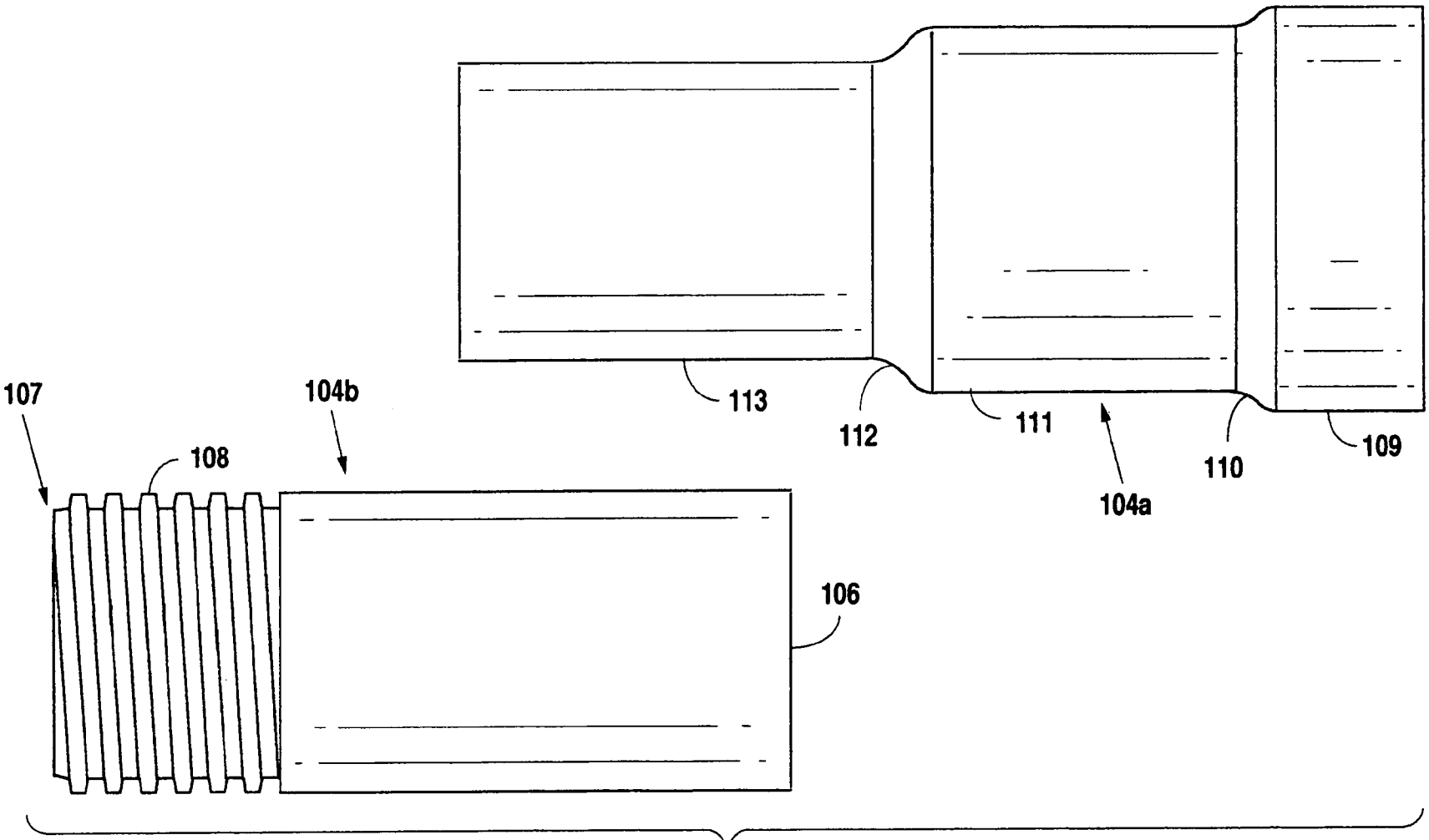
FIG. 3*a* is a perspective view of the casings of the present invention.
Figure 3B:
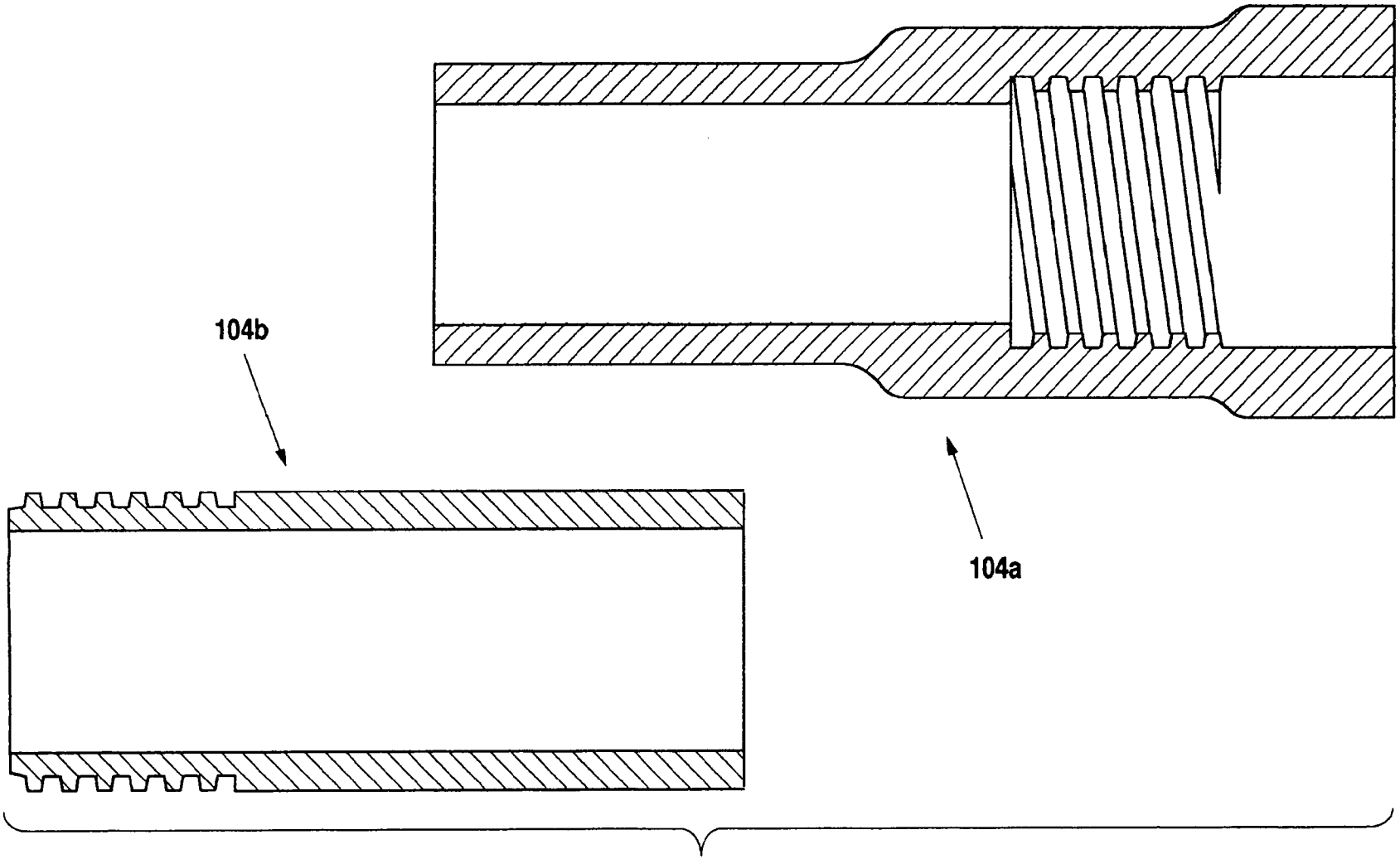
FIG. 3*b* is a perspective view illustrating the inside design of the casing of the present invention.

This concept is also equally applicable to well casings 104. Since casings 104 are wider in diameter appropriate adjustments need to be made to the first and second cylinder sections 109 and 111 and the first and second lipped portions 110 and 112. In addition, since the casing 104 is not responsible for the direct transport of water there is not necessarily a need to use triangular threads for a water tight connection for threads 108 and 114. Instead square threads can be used and threaded ends can be squared off. A perspective view of the casings 104 of the present invention is illustrated in FIGS. 3*a* and 3*b*.

Figure 4:
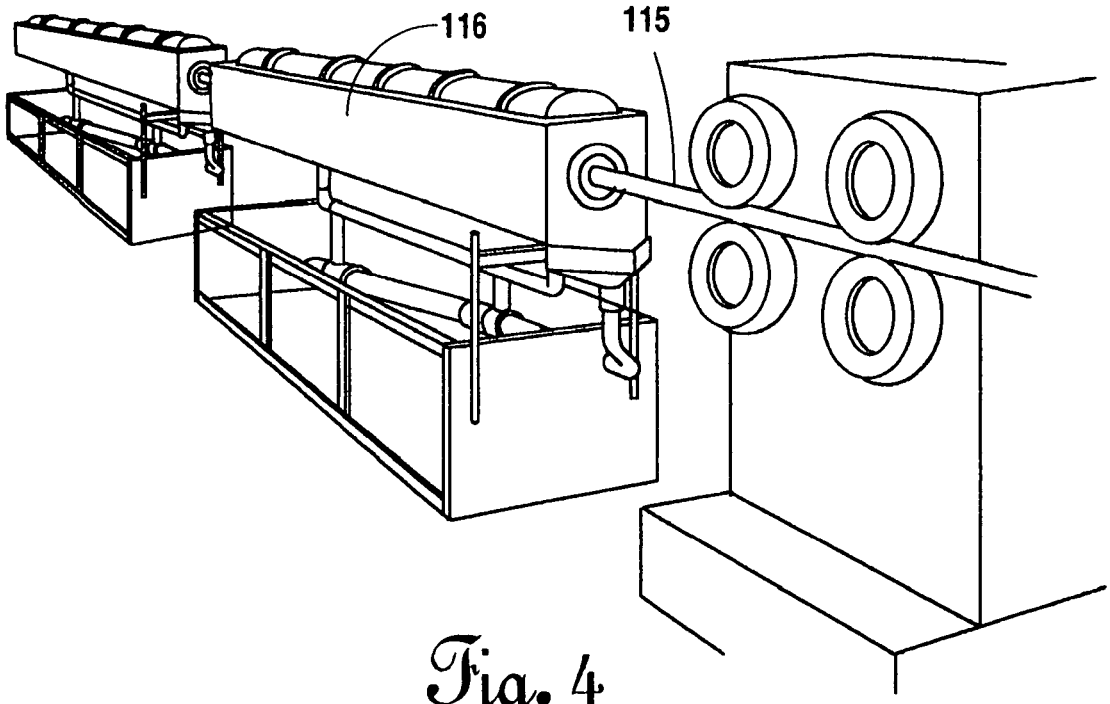
FIG. 4 is a perspective view of the extruding step in the method of manufacturing of the present invention.
Figure 5:
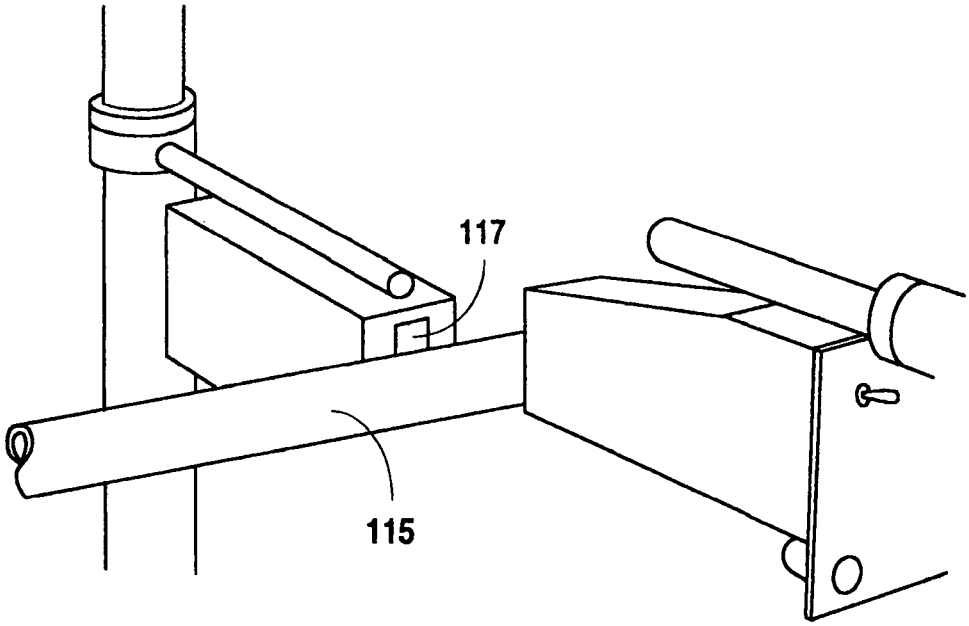
FIG. 5 is a perspective view of the cutting step in the method of manufacturing of the present invention.
Figure 6:
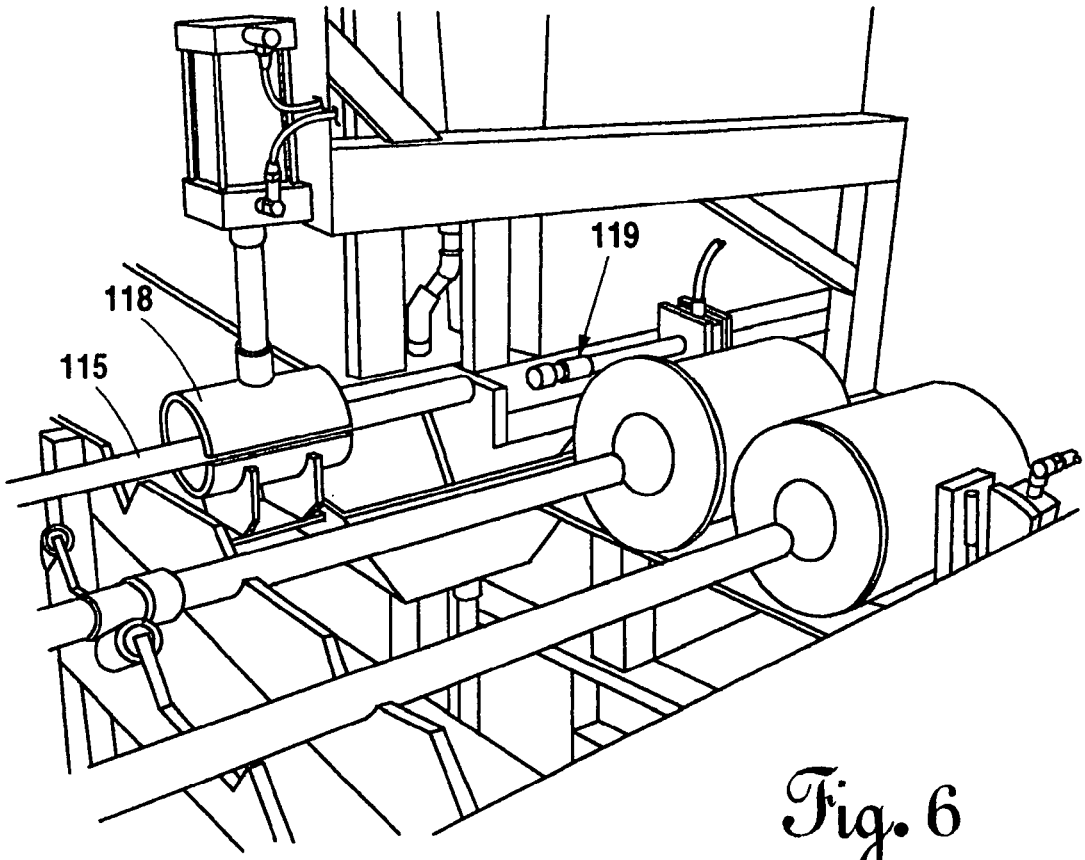
FIG. 6 is a perspective view of the heating and forming steps in the method of manufacturing of the present invention.
Figure 7:
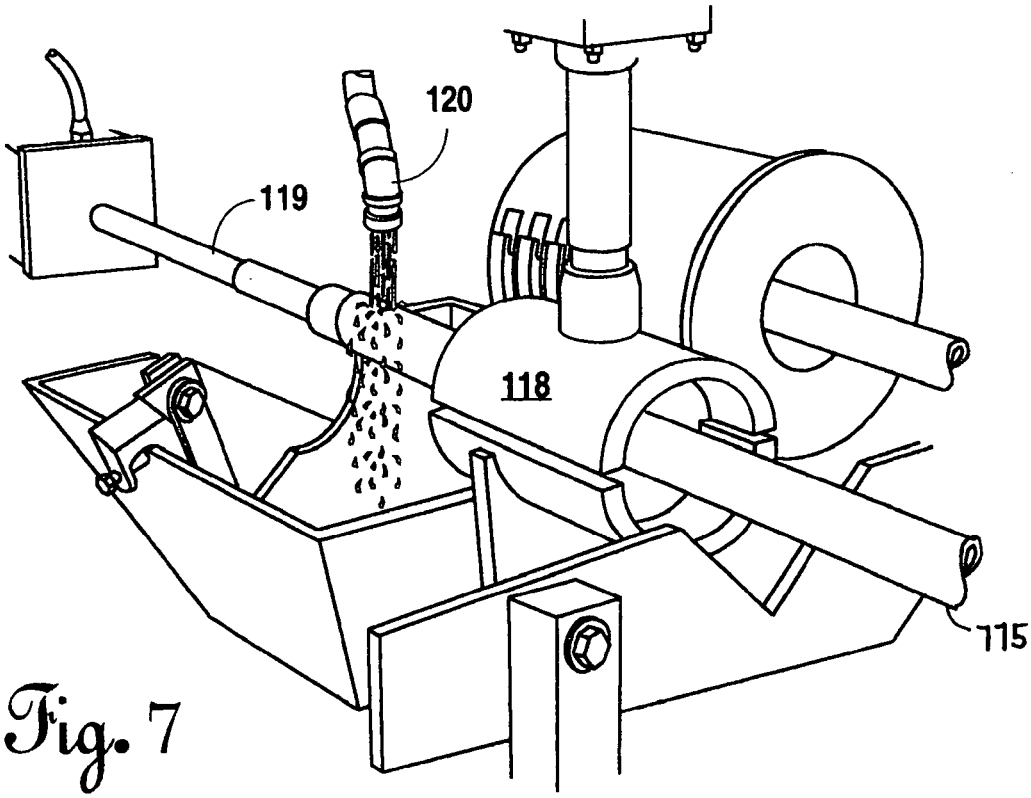
FIG. 7 is a perspective view of the cooling step in the method of manufacturing of the present invention.

The method of manufacture for the drop pipe 103 and casing 104 consists of several steps. In the first, or extruding, step as illustrated in FIG. 4, standard PVC pipe 115 of the appropriate diameter is extruded at an extruder 116. During the extrusion process, the characteristics of the pipe 115 are printed on the side of pipe 115 by an ink jet printer (not shown). Once the PVC pipe 115 is extruded in the extruding step, it is then carried through a sensor 117 during the cutting step where it is cut to the appropriate length as shown in FIG. 5. In the heating step as shown in FIG. 6, one end of pipe 115 is heated with a heater 118 to render it pliable. After the end of pipe 115 is heated it is removed from the heater 118 and moved to a second location where it is clamped in place. After it is clamped in place and while the end is still pliable, a die 119 is forced by a hydraulic cylinder into the pliable end of pipe 115 during the forming step. Die 119 is made of metal and has three contiguous stair stepped sections with two adjoining lipped sections of appropriate dimensions to form the first and second cylinder sections 109 and 111, the first and second lipped portions 110 and 112 and the terminal section 113. When the die 119 is forced into the end of pipe 115, the pipe 115 with the die 119 still inside is immersed in cool water from water source 120 to harden the plastic so as to conform it to the shape of the die 119. This cooling step is illustrated in more detail in FIG. 7. Since the metal expands more than the plastic as a result of the cooling, the die 119 can be removed without effort.

Figure 8A:
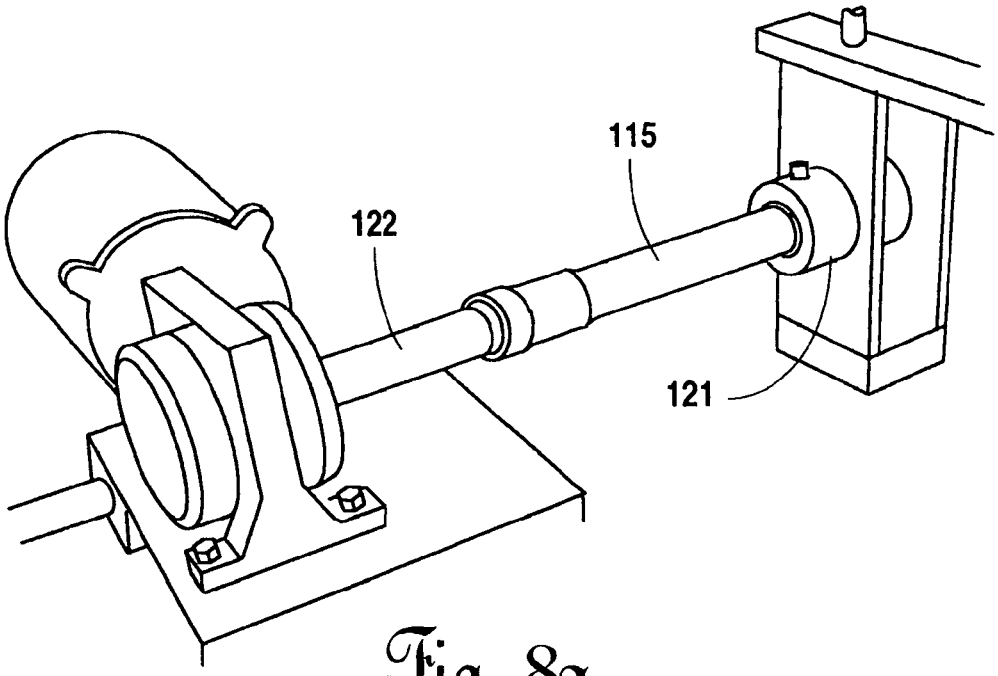
FIG. 8*a* is a perspective view of the thread cutting step in the method of manufacturing of the present invention for the drop pipe.
Figure 8B:
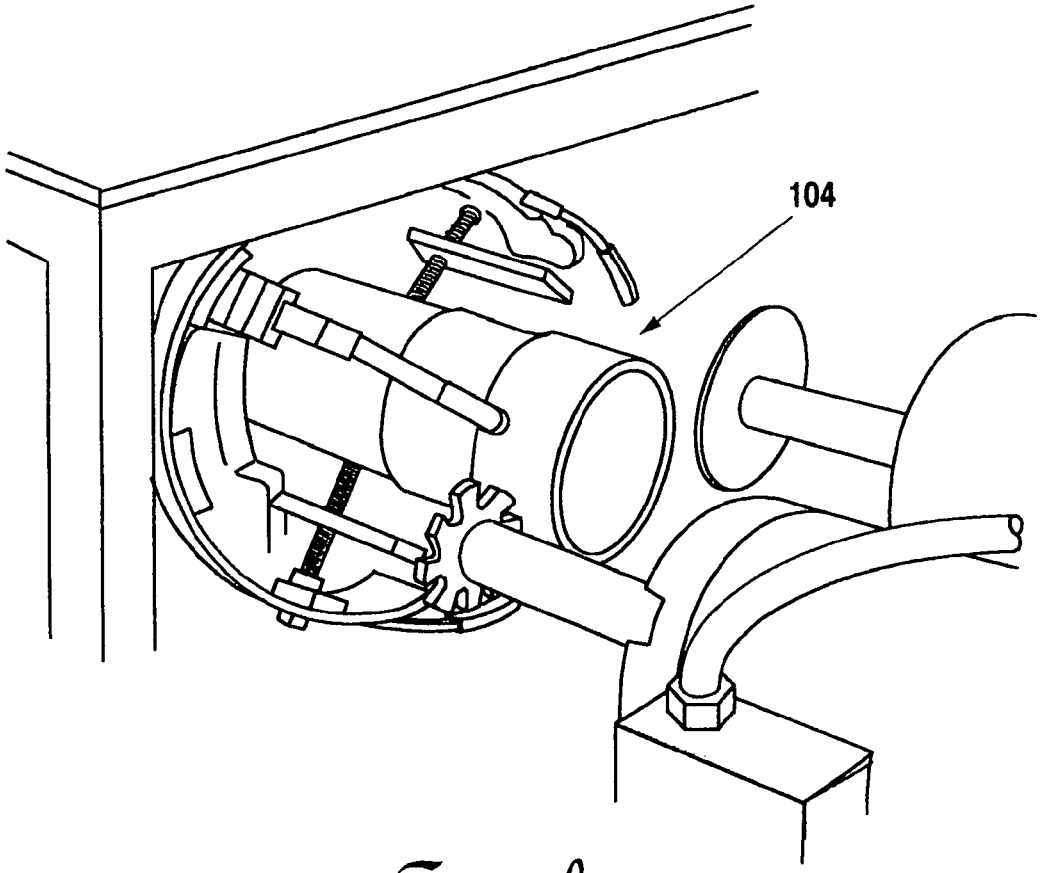
FIG. 8*b* is a perspective view of the thread cutting step in the method of manufacturing of the present invention for the casing.

FIGS. 8*a* and *b* illustrate the next step of thread cutting. Drop pipe 103 is illustrated in FIG. 8*a*. Pipe 115 is placed into a static block 121 and connected to the rotating block 122 in preparation for the threading process. During this step the inside portion of pipe 115, more particularly the portion that will be used as base 103*b*, is threaded into either triangular threads for the drop pipe 103 or square threads for the casing 104. The threads on this portion are threaded with standard female threads. In addition, the outside portion of pipe 115, more particularly the portion that will be used is for the seated connector 103*a*, is threaded into either triangular threads for the drop pipe 103 or square threads for the casing 104. The threads on this portion are threaded with standard male threads. An internal bevel can be added to the base 103*b* and used for alignment purposes at this stage. In addition an outside bevel can be added as well. The only distinction would be for the casings 104. On the casings 104, very loose threads are utilized to encourage leaking. To accomplish this, prior to the threading of second cylinder section 111, the ends of pipe 115 must be squared off. Next, a router is run inside the pipe 115 to make sure that the pipe 115 is circular. The thread cutting step for the square threads of the casings 104 is illustrated in FIG. 8*b*.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

We claim:

1. A method of manufacture of a single piece polyvinyl chlorine (PVC) pipe for connection to a similar PVC pipe comprising the steps of:

extruding said pipe into a predetermined interior diameter;

cutting said pipe to a desired length, said pipe having a male end and a female end with said male end having a substantially uniform circumference;

forming first and second enlarged interior diameters at said female end by inserting a die into the female end;

said second enlarged interior diameter terminating said female end and being (a) slightly larger in diameter than a male end of a similar adjacent pipe; (b) having sufficient length to provide lateral strength when connected to said similar adjacent pipe; and (c) being at least long enough to receive most of the engaging threads of a male end of said similar PVC pipe;

cooling said female end with water while the die is inserted in the pipe;

internally threading the first enlarged diameter; and externally threading said male end.

2. The method of manufacture of a single polyvinyl chlorine (PVC) pipe assembly connection of claim 1 further comprising step of:

heating said female end of said pipe to render it pliable prior to forming said first and second enlarged interior diameters.

3. The method of manufacture of a single polyvinyl chlorine (PVC) pipe assembly connection of claim 1 further comprising the step of beveling said male end or said female end.

4. The method of manufacture of a single polyvinyl chlorine (PVC) pipe assembly connection of claim 1 wherein the threads of said internally and externally threading steps are triangular.

5. The method of manufacture of a single polyvinyl chlorine (PVC) pipe assembly connection of claim 1 wherein the threads of said internally and externally threading steps are square.

6. A method of manufacture of a single piece polyvinyl chlorine (PVC) pipe for connection to a similar PVC pipe comprising the steps of:

extruding said pipe into a predetermined interior diameter;

cutting said pipe to a desired length, said pipe having a male end and a female end with said male end having a substantially uniform circumference;

forming a first enlarged interior diameter at said female end;

forming a second enlarged interior diameter at said female end wherein said second enlarged interior diameter terminating said female end and being (a) slightly larger in diameter than a male end of a similar adjacent pipe; (b) having sufficient length to provide lateral strength when connected to said similar adjacent pipe; and (c) being at least long enough to receive most of the engaging threads of a male end of said similar PVC pipe;

internally threading said first enlarged diameter; and externally threading said male end.

7. The method of manufacture of a single polyvinyl chlorine (PVC) pipe assembly connection of claim 6 further comprising steps of:

heating said female end of said pipe to render it pliable;

cooling said pipe after forming said first and second enlarged interior diameters.

8. The method of manufacture of a single polyvinyl chlorine (PVC) pipe assembly connection of claim 6 further comprising the step of beveling said male end or said female end.

9. The method of manufacture of a single polyvinyl chlorine (PVC) pipe assembly connection of claim 6 wherein the threads of said internally and externally threading steps are triangular.

10. The method of manufacture of a single polyvinyl chlorine (PVC) pipe assembly connection of claim 6 wherein the threads of said internally and externally threading steps are square.

* * * * *